US007056152B2

(12) United States Patent
Huang et al.

(10) Patent No.: US 7,056,152 B2
(45) Date of Patent: Jun. 6, 2006

(54) OUTER SHELL MODULAR STRUCTURE OF A CONNECTOR

(75) Inventors: Hung Way Huang, Taipei (TW); Swu Lin Dwan, Xinchin (CN); Wei Wan, Xinchin (CN)

(73) Assignee: Advanced Connectek Inc., Taipei (TW)

( * ) Notice: Subject to any disclaimer, the term of this patent is extended or adjusted under 35 U.S.C. 154(b) by 0 days.

(21) Appl. No.: 10/906,503

(22) Filed: Feb. 23, 2005

(65) Prior Publication Data

US 2005/0186847 A1 Aug. 25, 2005

(30) Foreign Application Priority Data

Feb. 22, 2004 (TW) ..... 93216861 U

(51) Int. Cl.
*H01R 13/648* (2006.01)

(52) U.S. Cl. ..... 439/607; 439/701

(58) Field of Classification Search ..... 439/607 I, 439/610, 701 X

See application file for complete search history.

(56) References Cited

U.S. PATENT DOCUMENTS

| | | | | |
|---|---|---|---|---|
| 5,222,909 | A * | 6/1993 | Nomura et al. | 439/607 |
| 5,701,681 | A * | 12/1997 | Wonka et al. | 34/97 |
| 6,508,671 | B1 * | 1/2003 | Ko | 439/610 |
| 6,508,678 | B1 * | 1/2003 | Yang | 439/677 |
| 6,595,801 | B1 * | 7/2003 | Leonard et al. | 439/607 |
| 6,709,286 | B1 | 3/2004 | Korsunsky et al. | 439/557 |

* cited by examiner

*Primary Examiner*—Thanh-Tam Le

(57) ABSTRACT

The invention relates to an outer shell modular structure of a connector, which includes a protective shell, a front shell, a central shell and a rear shell, therein, the protective shell is sleeved on the contact portion of the connector, the front and rear shells are assembled to the connector metal case and fastened by the corresponding clasping means formed on the two sides of the connector metal case, the front and rear shells each has an abutting portion, the central shell is connected among the front and rear shells, the central shell is fastened firmly by engaging with the abutting portions of the front and rear shells, thus prevent the central shell from shifting around for using conveniently.

4 Claims, 5 Drawing Sheets

OUTER SHELL MODULAR STRUCTURE OF A CONNECTOR

BACKGROUND OF THE INVENTION

1. Field of the Invention

The present invention relates to an outer shell modular structure of a connector, especially to an outer shell module in multi-piece assembly mode applied in a connector.

2. Prior Art

With the unceasing changes of the market demands, people are stricter to the connection requirements between electronic products and the peripheral devices when they use electronic devices. This is a severe challenge to the main manufacturers, and this also stimulates the manufacturers to create new situations. At the present, the plastic outer shell of a miniature connector is unitarily over-molded, but when the plastic outer shell of a relatively larger connector is unitarily over-molded, it must consider the flowing rate or speed of the melted plastic, it has to use higher injection pressure, so it is usually hard to achieve a satisfied effect in controlling the mold shrink rate.

In the cable connector exploited at the present days, the plastic outer shell protecting the connector is over-molded by an injection machine after the half-finished connector is placed into the predetermined mold. At that time, the plastic has a running nature under high temperatures, and because the injection machine injects under a great pressure, the melted plastic is hard to be avoided from flowing into the interior of the connector, which affects the quality of the signal transmission in the connector. On the other hand, the connector plastic outer shell is over-molded during the production, the plastic outer shell could not be produced in large scale before the formal production; if an plastic outer shell in assembly mode is conceived, now the plastic outer shell could be injection-molded beforehand, then get it assembled in production; thus it can be seen that such an assembly-mode plastic outer shell could be produced and stored in large scale, and could be taken over at any time when the production is necessary, so it has a perfect flexibility. In order to overcome the above said defects of the connector, it should be innovated necessarily.

SUMMARY OF THE INVENTION

The main object of the invention is to provide an outer shell modular structure of a connector; the outer shell is designed in multi-piece assembly mode, which improves the quality of the connector shell to meet requirements.

It is another object of the invention to provide an outer shell modular structure of a connector, which makes use of assembly and design features thereof to produce and store in large scale so as to improve the production efficiency.

It is a further object of the invention to provide an outer shell modular structure of a connector, adopts a pre-molded module to simplify the production process so as to provide a variable assembly mode.

To achieve the above said objects, the present invention could be accomplished by the following technical scheme: the plastic outer shell of the connector consists of a protective shell, a front shell, a central shell, a half-assembled connector and a rear shell. Therein, the protective shell has an insertion chamber, which is sleeved onto the contact portion of the connector; the front shell, is in a rectangular shape, has a main portion and a convex portion extended from the rear side of the main portion, on the convex portion extending out an abutting portion, a lateral section of which is smaller than that of the convex portion, from a surface of the abutting portion to interior of the main portion extending a retaining chamber, on inner two sides of the retaining chamber each having a recess which could engage with clasping portions on two sides of a metal case of the connector, the retaining chamber communicating with an insertion hole on front side of the main portion; the central shell is a rectangular structure, which has a retaining section extending from front side to back side, on inner front and back portions of the retaining chamber each having a circular slot, adjacent to each circular slot having a circular convex portion, between the two circular convex portion having a partition plate for fastening the central shell; the rear shell has a convex portion extending outward from the front surface of main portion thereof, on the convex portion extending an abutting portion, a lateral section of which is smaller than that of the convex portion, from the surface of the abutting portion to the interior of the main portion extending a retaining chamber, on the inner two sides of the retaining chamber each having a recess which could engage with the clasping portions on the two sides of the metal case of the connector. The assembly sequences of the connector are as following: the rear shell is sleeved onto the metal case from the rear side first (the semi-finished connector has to be connected with the cable beforehand) and connected firmly through the clasping means on the metal case, the central shell is sleeved onto the metal case from the front side of the semi-finished connector, then the front shell is sleeved on in the same direction, the front shell is engaged firmly through the clasping means on the metal case, at the same time, the front shell together with the rear shell are engaged with the central shell, the central shell is fastened and could not be shifted around; lastly, the protective shell is sleeved onto the contact portion of the connector to protect the surfaces of the connector contact portion from damage, now end the assembly operation of the whole connector.

Compared with the prior arts, the advantages of the present invention lie in: the plastic outer shell of the connector adopting a multi-piece design mode, before the connector is assembled, to avoid the melted plastic from overflowing into the interior of the connector when the semi-finished connector is placed directly into the mold for over-molding, thus improve the quality of the signal transmission of the connector; the plastic outer shell could be produced and stored in large scale before formal production to prepare for the formal production, so improve the production efficiency.

In order for those skilled in the art to comprehend fully the structure features of the invention, as well as other objects and functions of the invention, an embodiment is given here, the attached drawings will give a detailed description thereafter, the chosen embodiment is only illustrative to the present invention, the invention still has other embodiments, any other modifications or changes made by those skilled in the art via the specification without departing from the spirit of the invention are covered in the claims of the present invention.

DETAILED DESCRIPTION OF THE PREFERRED EMBODIMENT

An embodiment is given here to make a more clear and detailed description of the invention.

Figure 1:
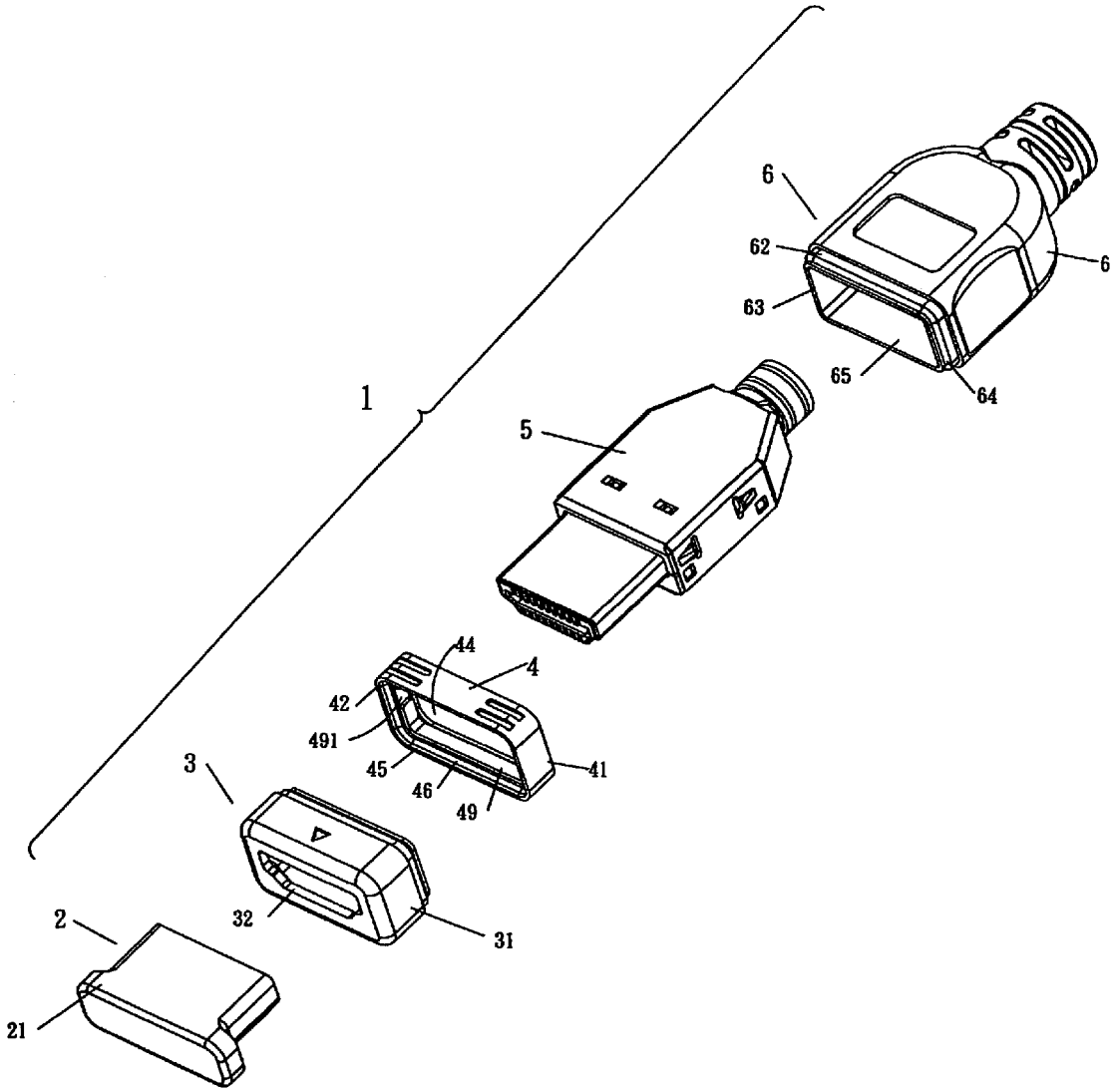
FIG. 1 is an exploded perspective view of the preferred embodiment of the invention.

As shown in FIG. 1, the given embodiment is an HDMI connector, the connector 1 consists of a protective shell 2, a front shell 3, a central shell 4, a half-assembled connector 5 and a rear shell 6. Therein, the protective shell 2, the front shell 3, the central shell 4 and the rear shell 6 make up the plastic outer shell of the connector 1. Now a detailed description is given to the assembly-formed plastic outer shell.

Figure 2:
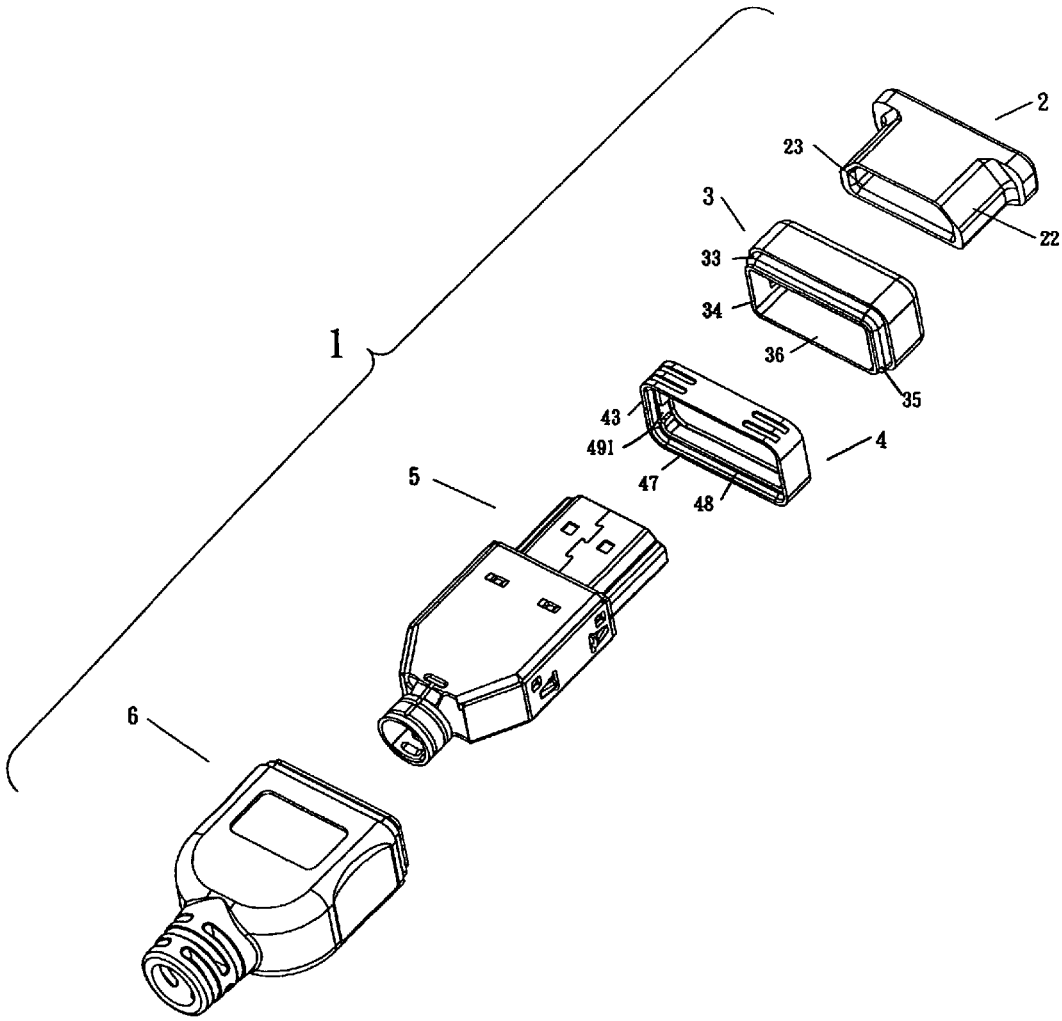
FIG. 2 is an exploded perspective view of the preferred embodiment of the invention from another angle.

As shown in FIGS. 1 and 2, the protective shell 2 is adapted to be sleeved onto the contact portion of the connector 1, the protective shell 2 includes an upright main portion 21 and a receiving portion 22 extending from the front surface of the main portion 21, inside the receiving portion 22 having an insertion chamber 23, in the present embodiment, the shape of the insertion chamber 23 is identical to the standard interface of the HDMI connector.

Figure 7:
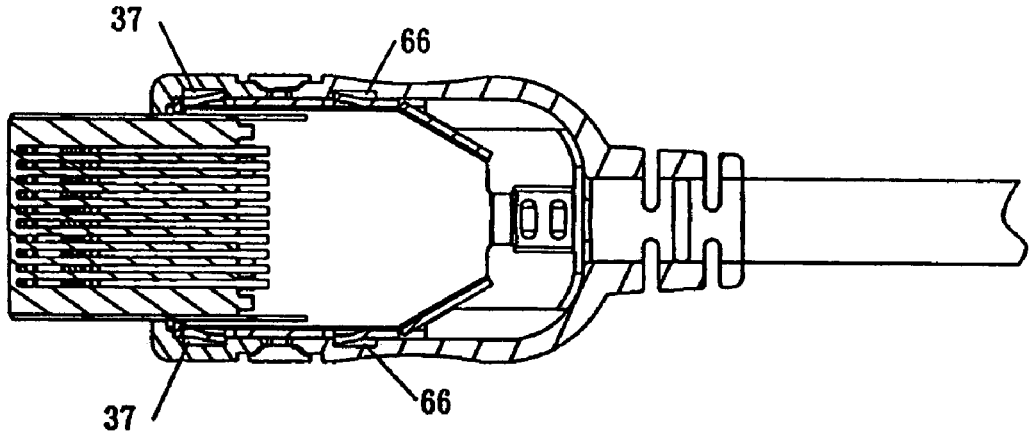
FIG. 7 is a sectional view taking along a line A—A in FIG. 6.

The front shell, a circular structure in rectangular shape, includes a main portion 31, in the center of the front side of the main portion 31 having an insertion hole 32 for the standard HDMI connector, on the rear surface of the main portion 31 extending outward a convex portion 33, on the surface of the convex portion 33 extending out an abutting portion 34, the lateral section of which is smaller than that of the convex portion 33, between the abutting portion 34 and the convex portion 33 extending an arch portion 35, from front surface of the abutting portion 34 to interior of the main portion 31 extending a retaining chamber 36, the retaining chamber 36 communicating with the front insertion hole 32 so as for the connector 5 to pass through smoothly, on the inner two sides of the retaining chamber 36 each having a recess 37 which could engage with the clasping portions on the two sides of the metal case of the connector 5 (as shown in FIG. 7), the front shell 3 is fastened firmly by recesses 37 engaged with clasping portions on a metal case.

The central shell 4, is also a circular structure in rectangular shape, includes a base portion 41, the base portion 41 has a retaining section 44 extending from front surface 42 to rear surface 43 thereof, on inner front and rear surfaces of a retaining section 44 having a circular slot 45 or 47 respectively, adjacent to the circular slots 45,47 having a circular convex portion 46 or 48 respectively, between the two circular convex portions 46,48 having an unclosed partition plate 49, on two sides of the partition plate 49 each opening a notch 491 for the clasping portions on the two sides of the metal case of the semi-finished connector 5 to pass through, the partition plate 49 is provided for the abutting portions of the front and rear shells 3,6 to be connected so as to fasten the central shell 4.

The rear shell 6, for accommodating the metal case of the half-assembled connector 5, has a main portion 61, on a front part of a main portion 61 extending outward a convex portion 62, on front surface of the convex portion 62 extending an abutting portion 63, a lateral section of which is smaller than that of the convex portion 62, between the convex portion 62 and the abutting portion 63 having an arch portion 64, from the surface of the abutting portion 63 to interior of the main portion 61 extending a retaining chamber 65, the retaining chamber 65 is for accommodating the metal case of the connector 5, on inner two sides of the retaining chamber 65 each having a recess 66 for engaging with the clasping portions on two sides of the metal case of the connector 5, the rear shell 6 is fastened firmly by recesses 66 engaged with corresponding clasping portions (as shown in FIG. 7).

Figure 3:
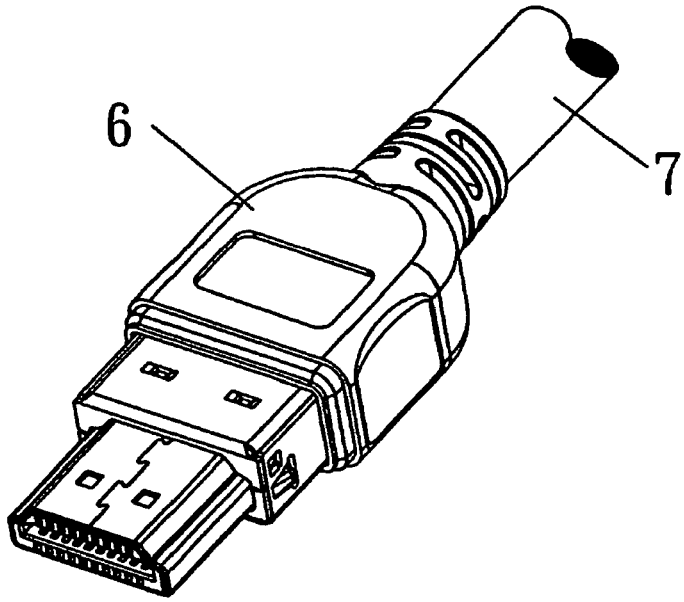
FIG. 3 is a perspective view showing how the rear shell is assembled in the preferred embodiment of the invention.
Figure 4:
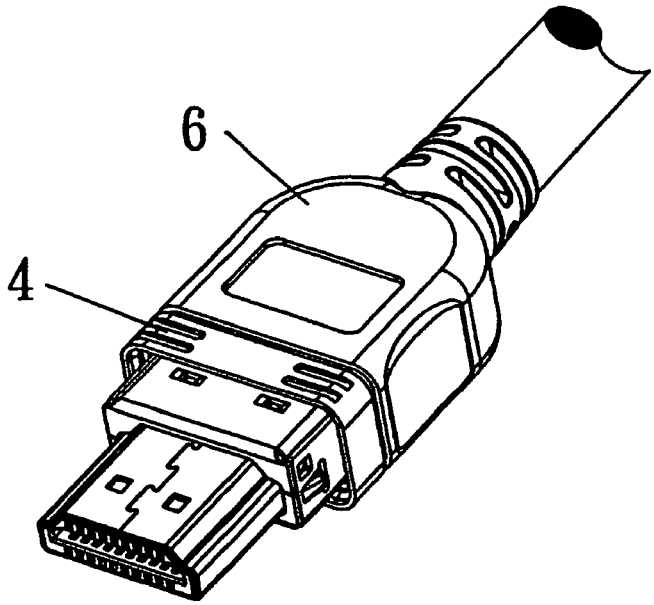
FIG. 4 is a perspective view showing how the central shell is assembled in the preferred embodiment of the invention.
Figure 5:
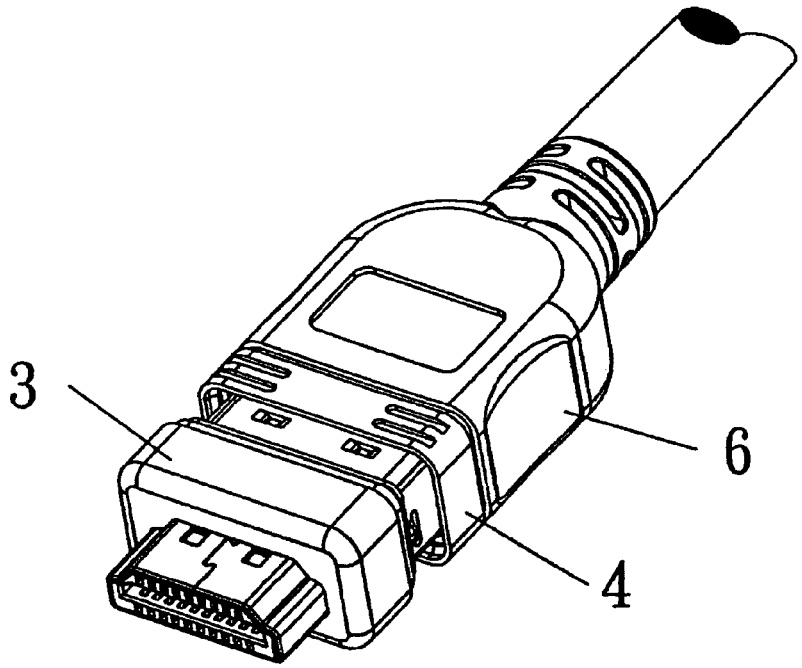
FIG. 5 is a perspective view showing how the front shell is assembled in the preferred embodiment of the invention.
Figure 6:
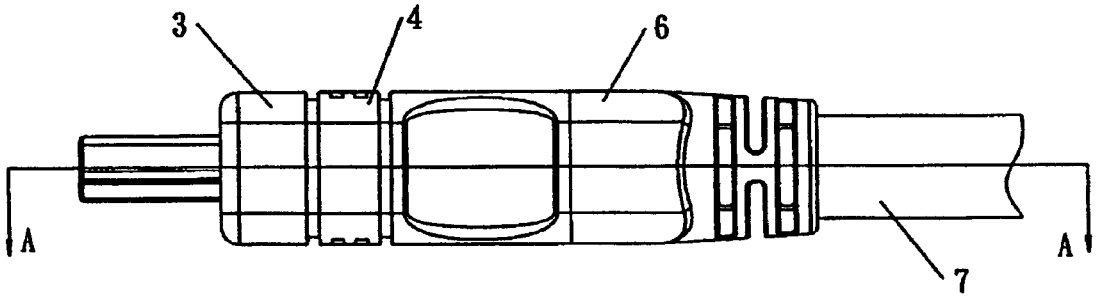
FIG. 6 is a front view of the preferred embodiment of the invention after the front shell is assembled fully.
Figure 8:
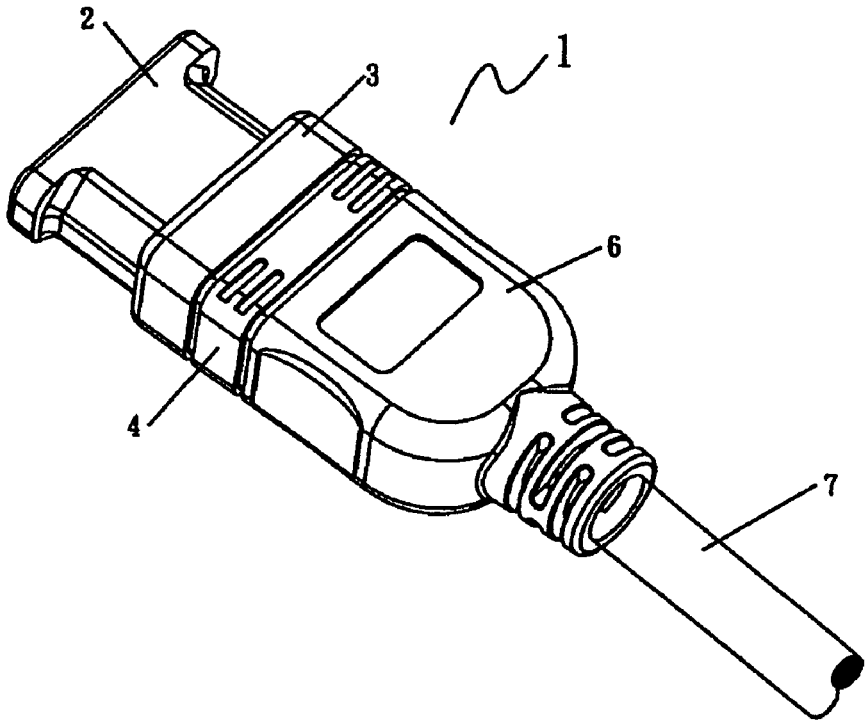
FIG. 8 is a perspective view of the preferred embodiment of the invention after the connector is assembled entirely.

In the present invention, the assembly of the connector plastic outer shell could be completed without any auxiliary tool. Before the formal assembly, the cable 7 must be passed through the rear shell 6 first, then assemble the plastic outer shell after the cable 7 and the half-assembled connector 5 are connected, as shown in FIG. 3, the rear shell 6 could be sleeved onto the metal case with only a push by hand, the rear shell 6 is fastened firmly by the recesses 66 on the inner two sides of the retaining chamber 64 of the rear shell 6 engaged with the corresponding clasping portions on the metal case; as shown in FIG. 4, the central shell 4 is directly sleeved onto the metal case from the front of the connector, at this time, the central shell 4 is not fastened until it is assembled with the front shell 3, as shown in FIG. 5, the front shell 3 is sleeved on from the front of the connector, the front shell 3 is fastened firmly by the recesses 37 on the inner two sides of the insertion chamber 36 are engaged respectively with the clasping portions on the two sides of the metal case; as shown in FIG. 6, in the mean time, the abutting portion 34 of the front shell 3 and the abutting portion 63 of the rear shell 6 are abutted against the two sides of the partition plate 49 of the central shell 4 respectively, the central shell 4 could not be shifted around under the holding strength from the two sides to achieve a fastening function; the protective shell 2 is sleeved onto the contact portion of the connector 5, the protective shell 2 is adapted to safeguard the contact portion of the connector from damage during informal use or transportation, now end the assembly of the entire connector (as shown in FIG. 8).

Seen from the above description, the connector in the present invention has distinct advantages: the plastic outer shell of the connector is designed by adopting a three-piece structure, an unique structure, which could improve the quality of signal transmission of the connector; the plastic outer shell could be produced and stored in large scale before the formal production, thus the production efficiency is improved.

What is claimed is:

1. A multi-piece assembled plastic outer shell of an electrical connector includes a protective shell, a front shell, a central shell and a rear shell, wherein:

the central shell is detachably connected between the front and rear shells each of the front and rear shells having an abutting portion, and the central shell is fastened firmly by engaging with the abutting portions of the front and rear shells respectively;

the front shell having engaging recesses formed on inner two sides of a retaining chamber, from a surface of the abutting portion to interior of a main portion thereof extending the retaining chamber, is detachably assembled to a connector metal case and fastened by said engaging recesses and clasping portions formed on two sides of the connector metal case;

the rear shell having engaging recesses formed on inner two sides of a retaining chamber, from a surface of the abutting portion to interior of a main portion thereof extending the retaining chamber, is detachably assembled to the connector metal case and fastened by said engaging recesses and clasping portions formed on the two sides of the connector metal case;

the protective shell is detachably sleeved on a contact portion of the connector, wherein the protective shell including a main portion and a receiving portion extended from a front surface of the main portion.

2. A multi-piece assembled plastic outer shell of an electrical connector as claimed in claim 1, wherein said connector metal case is disposed in the plastic outer shell to be used for receiving a cable and contact terminals.

3. A multi-piece assembled plastic outer shell of an electrical connector as claimed in claim 1, wherein said detachable central shell has a circular slot respectively on inner front and rear sides of a retaining chamber thereof, a circular convex portion furnished in adjacent to each circular slot, an unclosed circular partition plate furnished between two circular convex portions, and an opening notch furnished on two sides of a partition plate.

4. A multi-piece assembled plastic outer shell of an electrical connector as claimed in claim 1, wherein said detachable protective shell includes an insertion chamber inside the receiving portion.

* * * * *